US006743107B2

(12) United States Patent
Dubeta

(10) Patent No.: US 6,743,107 B2
(45) **Date of Patent: *Jun. 1, 2004**

(54) SLIDE APPARATUS

(75) Inventor: David J. Dubeta, Norglenwold (CA)

(73) Assignee: Water Fun Products, Corp. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/216,321

(22) Filed: Aug. 12, 2002

(65) Prior Publication Data

US 2002/0193169 A1 Dec. 19, 2002

Related U.S. Application Data

(63) Continuation-in-part of application No. 09/620,560, filed on Jul. 20, 2000, now Pat. No. 6,450,891.

(60) Provisional application No. 60/157,842, filed on Oct. 6, 1999.

(51) Int. Cl.[7] ..... A63G 21/10

(52) U.S. Cl. ..... 472/116; 472/117

(58) Field of Search ..... 472/116, 117, 472/128, 129; 104/53, 67, 69, 70

(56) References Cited

U.S. PATENT DOCUMENTS

| | | | | | |
|---|---|---|---|---|---|
| 4,196,900 | A | * | 4/1980 | Becker et al. | 472/117 |
| 4,910,814 | A | * | 3/1990 | Weiner | 4/488 |
| 5,137,497 | A | * | 8/1992 | Dubeta | 472/88 |
| 5,738,590 | A | * | 4/1998 | Lochtefeld | 472/117 |
| 6,450,891 | B1 | * | 9/2002 | Dubeta | 472/117 |

* cited by examiner

*Primary Examiner*—Kien Nguyen
(74) *Attorney, Agent, or Firm*—Wells St. John P.S.

(57) ABSTRACT

Slide apparatus includes a first slide, which may have a somewhat parabolic configuration having a trough and/or a switchback. The switchback is oriented and configured for changing the direction of travel of a user. Multiple troughs and switchback elements may be provided so as to maximize the length of time during which a user slides, yet without increasing water usage, energy requirements, and space requirements. A switchback element may be configured for reversing the direction of travel of the user from more than 0° to 180° or more. The switchback element may be configured for directing passengers in different directions along different paths, and yet, without a dividing wall therebetween, thanks to the configuration of the switchback elements. One or more partially or completely spiral slides may precede or follow the first slide.

30 Claims, 15 Drawing Sheets

SLIDE APPARATUS

CROSS REFERENCE TO RELATED APPLICATIONS

This application is a continuation-in-part of application Ser. No. 09/620,560, filed Jul. 20, 2000, now U.S. Pat. No. 6,450,891 which claims the priority of U.S. application Ser. No. 60/157,842, filed Oct. 6, 1999, and each of which is incorporated herein by reference.

FIELD OF THE INVENTION

The invention relates to amusement devices. More particularly, the invention relates to amusement devices sufficiently large so as to carry passengers and be placed in amusement parks and public recreation areas. Even more particularly, the invention relates to amusement rides, such as water slides, which use water to enhance the sliding of passengers or individual riders down substantially predetermined pathways.

BACKGROUND OF THE INVENTION

Slides, with or without the addition of water on the sliding surface thereof, which allow passengers or riders to slide downwardly into a stationary or moving body of water, have long been known.

Typically, early slides had relied on substantially straight downwardly slopped passageways in which the riders slid.

Previous improvements in the prior art slides include my earlier U.S. Pat. No. 5,137,497 to Dubeta, issued Aug. 11, 1992.

As the size of slide apparatuses (such as shown in my U.S. Pat. No. 5,137,497) increases, and the cost of labor and borrowing money increase, there is a requirement for a slide apparatus that can accommodate an even greater number of people in a shorter period of time.

The provision of such an improved slide apparatus would have the added benefit of shortening the time which passengers must wait in line. Such waiting is, needless to say, unacceptable to the majority of passengers; i.e., amusement park goers.

Accordingly, it can be seen that there is a need for a slide apparatus which can overcome these and other drawbacks of known devices.

OBJECTS AND SUMMARY OF THE INVENTION

It is an object of the invention to overcome the drawbacks of prior art slide apparatuses.

It is a further object of the invention to provide a slide apparatus which has a greater passenger throughput per hour than known devices, thereby shortening wait times for passengers, increasing the amusement value of the device, and maximizing the value of the installed device.

It is a further object of the invention to increase passenger throughput, yet without requiring greater water usage than existing devices.

A still further object is to lengthen the period of time during which a passenger is sliding, yet without increasing water usage, energy requirements, and space requirements, for example.

A further object of the invention is to provide an environmentally friendly water slide apparatus owing to its achieving the above objects of increased passenger throughput without increased demands for water, energy, and space, for example.

Another object of the invention is to provide a water slide having increased excitement value for the passengers, owing to its use of one or more switchback or "sidewinder" elements.

Yet another object of the invention is to provide a slide apparatus that changes the direction of travel of passengers in a small space, yet without the use of a dividing wall to separate passengers traveling in different (and even "opposite") directions.

A further object of the invention is to provide a slide apparatus which prevents users from engaging or "bouncing off" the sides of the pathways or trough, while achieving the desired speeds, excitement, and rapid changes of direction.

Another object of the invention is to provide a slide apparatus including a slide having at least a partially spiral slide configured for causing a user to travel along a partially spiral path, as well as including a further slide which includes a portion of an upwardly open parabolic curve.

A still further object of the invention is to provide a slide apparatus defining a path along which a user travels along one or more substantially completely spiral curves and/or along one or more slide surfaces that are defined by one or more surfaces which are defined by one or more partially or completely upwardly open parabolic surfaces.

In summary, the invention is directed to a slide apparatus including at least one trough defining at least one path along which a passenger travels, and at least one switchback trough or switchback operatively connected to the trough.

The invention is likewise directed to a slide apparatus having at least one path of travel along which a passenger travels, and at least one switchback which changes the direction of travel of the user without the use of a portion of a spiral path to accomplish the change of direction.

The invention is directed to a switchback configured for directing passengers in different directions, yet without the use of a dividing wall to separate two(2) paths along which the user travels; i.e., a first path along which the user travels in the first direction, and a second path along which the user travels in a second (e.g., return direction).

The invention is also directed to a slide apparatus including at least a portion of a spiral slide and a portion of an upwardly open parabolic slide surface.

The invention is directed to a slide apparatus in which a user traveling along a slide surface first travels along a downwardly extending path and then enters a lower portion of a slide surface which begins at a lower portion of an upwardly open at least partially parabolic slide surface, so that the user is caused to first travel upwardly along the parabolic slide surface and then travel downwardly along the parabolic slide surface, the upward and downward movement along the parabolic slide surface being repeated any of a number of times depending on the intended use of the slide apparatus.

It will be appreciated that relative terms such as up, down, left, and right are for convenience only, and are not meant to be limiting. The term user, for example, is intended to encompass all users, whether individual passengers sliding directly on the slide apparatus, sliding on a film or bed of water, sliding in a stream of water, sliding on conveyances, being carried mechanically along the slide apparatus, sliding on boats or tubes, or multiple passengers sliding with or without the use of conveyances.

Still further, the term "trough" is not intended to be limited to trough-like pathways along which a user may slide. The term trough, throughout the written description and claims, is intended to encompass all manners of pathways along which a user can slide, with or without accompanying water, and with or without the use of a conveyance on which the user travels.

The terms "slide" and "slide apparatus" may be used interchangeably herein.

The terms "parabola" and "parabolic" and "parabolic curve" are intended to include not just portions of parabolic surfaces, hyperbolic surfaces, hyperbolic paraboloids, or at least a portion of an elliptical surface, with or without undulations and variations in a slide surface portion of such surfaces, but are meant to include substantially all surfaces which cause a user of the slide surface to move upwardly and downward or downwardly and upwardly or both, and is not meant to be limited to a strict mathematical definition of the term. The illustrative embodiments set forth herein are intended to be examples of ones of an infinite number of curved slide surfaces that fall within the scope of the invention.

DETAILED DESCRIPTION OF THE INVENTION

Figure 1:
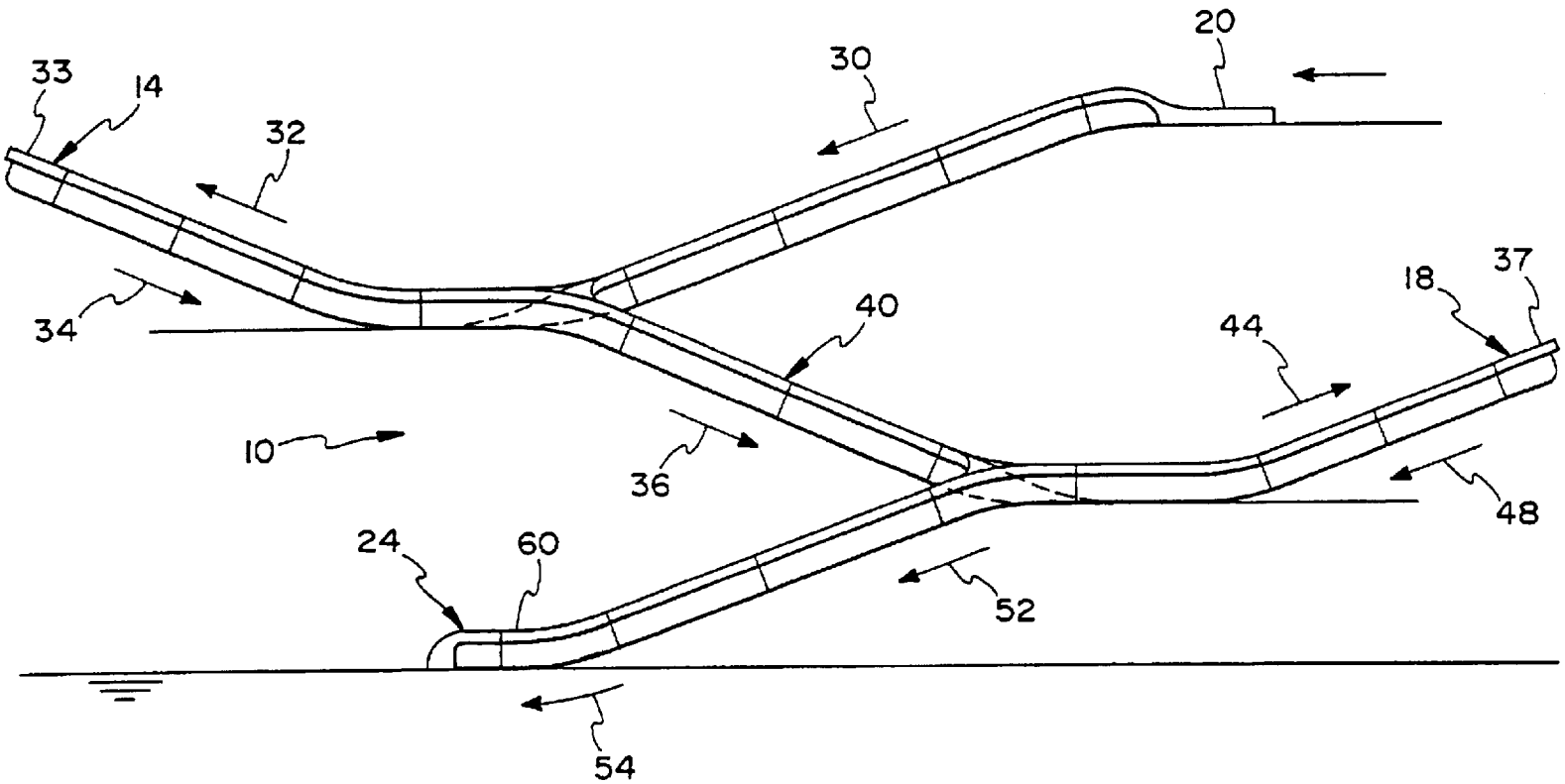
FIG. 1 illustrates a side view of a first preferred embodiment of a slide apparatus according the invention.

FIG. 1 illustrates a first preferred embodiment of a slide apparatus 10 according to the invention.

Slide apparatus 10 includes a left switchback 14 and a right switchback 18.

Typically, slide apparatus 10 will be provided with a starting area or a start tub 20 and an exit 24 which empties into a pool or runout, such as slow moving river.

Switchback elements 14 and 18, which have been termed "sidewinders", may be mirror images of each other, or may have distinct configurations.

Typically, the user enters at starting area 20, slides down in a direction 30 at least under the force of gravity, is pushed up or slid up against the force of gravity in a direction 32 toward the far left 33 of switchback 14 as shown in FIG. 1.

The user then returns in a direction 34 after a predetermined maximum height (i.e., an area in leftmost region 33 of switchback 14) has been achieved. The user continues on in a direction 36 along connecting slide or trough 40. The user's inertia carries the user upwardly and to the right in a direction 44 into switchback 18, until a predetermined rightmost height 37 has been achieved.

The user then starts sliding in a different (e.g., a substantially opposite) direction 48 downwardly to the left and continues on past connecting slide 40 in the directions of arrows 52 and 54 toward exit or runout 24.

The volume of water provided in a left portion 60 of exit 24 may be selected so that the user is stopped gradually or is provided with a large splash when the user encounters exit 24.

It will be appreciated that the slopes, heights, water volume, materials used, and the like may be varied so as to fine-tune the rate of speed of the users and/or the water volume requirements.

Figures 2, 3, 4:
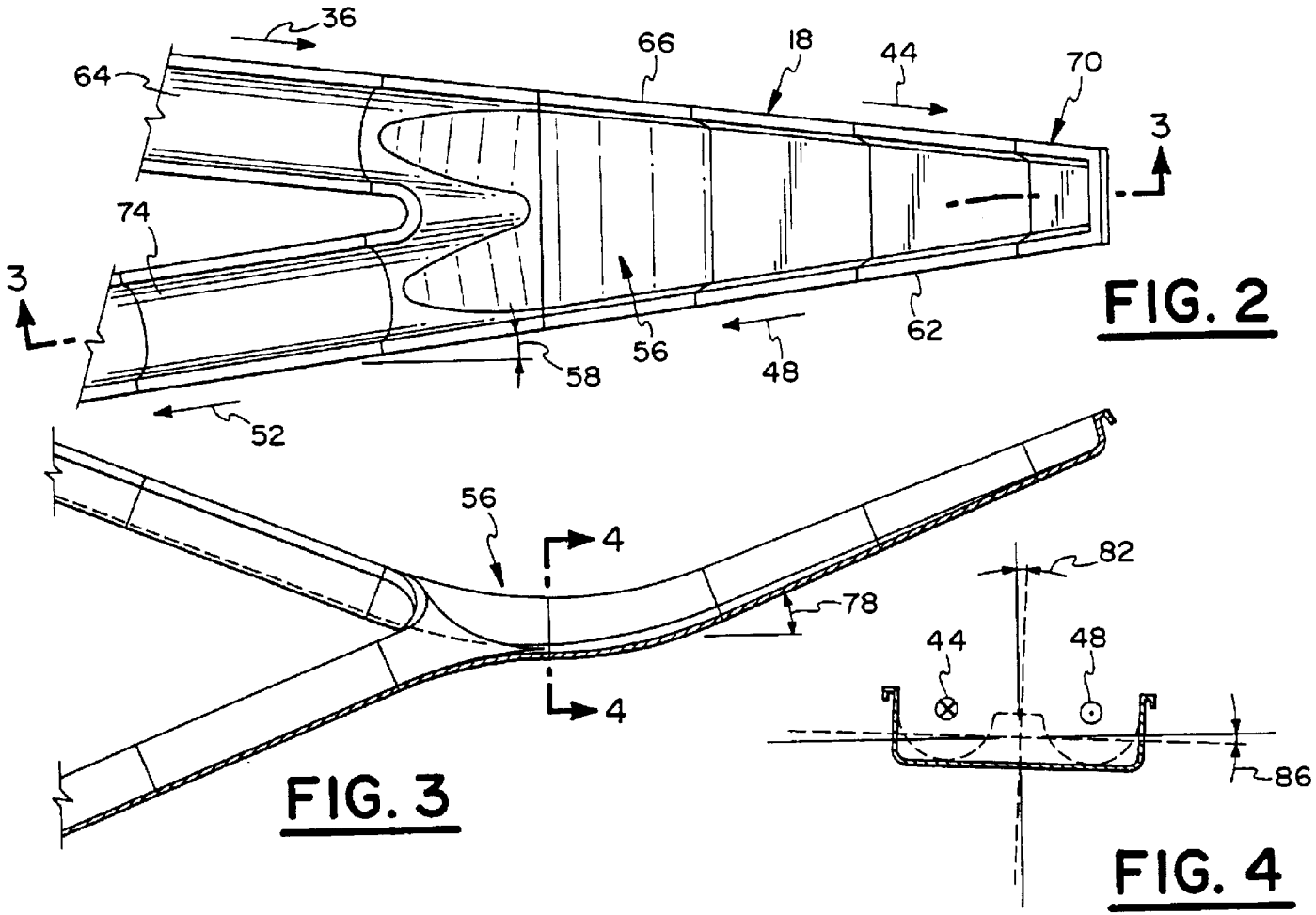
FIG. 2 is a top plan view of a switchback or sidewinder element according to the invention.
FIG. 3 is a partial sectional view taken along line 3—3 of FIG. 2.
FIG. 4 is a partial sectional view taken along line 4—4 of FIG. 3.

FIG. 2 is top plan view of a typical switchback or sidewinder element, such as switchback element 18 shown in FIG. 1.

As in FIG. 1, a user will enter switchback element 18 in direction 36 along a first trough or trough element or slide element 64. The user will continue in direction 44 until the user has reached an end region 70 at which the user's velocity has reached 0 owing to the slowing down of the user's rightward movement toward end region 70 owing to the force of gravity, the amount of water present, the material of the slide, the material of the passenger's conveyance, and the like. At that predetermined point in region 70, the user's velocity or speed will reach 0. At that point, the user will then begin moving ("accelerating") rearwardly in direction 48 and will continue to gain speed and will then pass into a second trough or slide element 74 in direction 52.

A portion 56 may be formed with gently curved surfaces to ensure that a user is directed in the desired direction from direction 36 into end region 70 of switchback 18, and then, when the user is returned along direction 52, the user is guided into the second trough element 74. Such gently sloping surfaces may be in the form of a part or all of a hyperbolic paraboloid.

FIG. 2 shows that the side walls 62 and 66 of the switchback element 18 may be inwardly angled at an angle 58 of greater than 0° or more. As shown, side walls 62 and 64 may be inwardly angled at about 7.5 degrees.

FIG. 3 illustrates a side view thereof, with an example of the elevation of switchback element 44 relative to the horizon at an angle 78 greater than 0° or more. As shown, angle 78 may be about 22.5 degrees, for example. The angle(s) will be varied depending on the length of switchback element 18, the desired speed, water volume providing a braking effect, and the like.

FIG. 4 shows that switchback element 18 may be slightly angled relative to the vertical and relative to the horizontal axes, for example, to ensure that the user exits through second trough 74 instead of exiting up into a portion of first trough 64 after having reversed course. Such angling of second trough 74 relative to first trough 64 ensures that the passenger throughput is maintained at a high rate and that the passengers enjoy the maximum velocity afforded by the gravitational pull exerted on them after reaching the quiescent (i.e., zero(0) velocity) point in region 70.

The angling or tilting of switchback element 18 about its longitudinal axis at an angle 86, helps ensure that a user returning rearwardly in direction 48 will be directed into second trough element 74 (instead of into first trough element 64).

Depending on the width, length and other variations of switchback element 18, as well as water volume and the like, the inward angling of angle 82 may vary from being greater than 0° to 2 or 30 or more. Angle 82 may be about 0°, depending on the overall size and intended use of switchback element 18.

FIG. 4 shows switchback element 18 may be angled at an angle 86 of 2–3° relative to the horizontal, as well as angled at angle 82 about 2–3° relative to the vertical. Angle 86 may be about 0° degrees.

Please note that direction 33 in FIG. 4 indicates the user is moving away from the viewer. Direction 48 indicates the user is moving toward the viewer. In both cases, the user could be facing the viewer or could be facing from the viewer. For example, the user could be moving up switchback element 18 in direction 44 while facing forwardly; then, the same user could return in direction 48 either facing rearwardly or forwardly.

Figure 5:
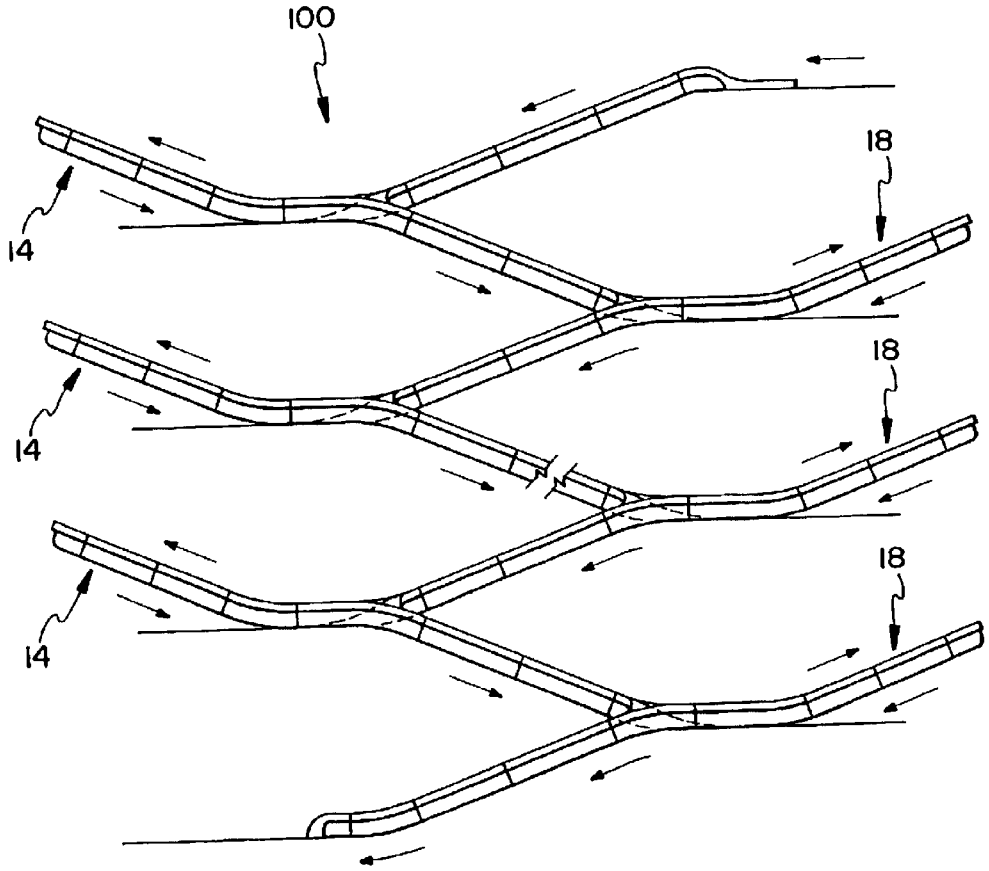
FIG. 5 illustrates a side view of a further preferred embodiment of a slide apparatus according to the invention.

FIG. 5 illustrates another preferred embodiment of a slide apparatus 100 having three(3) righthand and three(3) lefthand switchback elements 18 and 14, respectively. Switchback elements 18 and 14 may have the same or different configuration from those of FIG. 1. Any number of switchback elements may be provided.

As illustrated, slide apparatus 100 has three(3) righthand switchback elements 18 and three(3) left hand switchback elements 14.

FIGS. 6–14 illustrate another preferred embodiment of a switchback element 110 according to a further preferred embodiment of a invention. Switchback element 110 includes an upward travel region 112 and a downward travel region 116.

An entry 118 opens into upward travel region 112 at a portion thereof adjacent an opening into trough 64.

A further entry 120 opens into and is adjacent to an upper region of downward travel region 116.

Downward travel region 116 may be termed a return region or a return travel region, as travel region 116 is intended to guide and return the users returning in direction 48 after having reached an area near an outer end region 134. Return travel region 116 may be provided with an inner side wall and an outer side wall. The inner side wall may blend into or converge with the sideways outer portions of upward travel region 112.

Outer side wall 126 of downward travel region 116 will be configured for guiding users or passengers downwardly along the desired paths, such as into trough 74.

A lower or lowermost portion 132 of return travel region 116 may be provided to further guide and ensure that returning users are substantially free of engagement with upwardly moving users traveling in direction 44 along upward travel region 112.

Outer end region 134 may include a portion of switchback element 110 at which point the upward movement of the users has substantially stopped, and the downward movement of the user has begun; i.e., the point or region at which the user's velocity is approximately 0 m.p.h (km/h).

One or more strengthening elements 142 and 144 may be provided on switchback element 110. Strengthening elements 142, 144 may be made in the form of downwardly turned lips, as shown.

Additional strengthening ribs or supports 148 may be provided. In the case where switchback element is supported by a structural framework, strengthening ribs or supports 148 may be configured and be sufficiently large so as to be attached to the supporting framework. In the case where switchback element is a part of the slide system provided on a hillside, for example, strengthening ribs or supports 148 may form part of switchback element 110 that contacts the ground and supports switchback element 110 on the ground.

A curved guide portion 156 may be provided adjacent the transition between trough 64 and entry 118, and the transition between trough 74 and downward travel region 116 to further ensure that the users are guided in the desired direction in a smooth and efficient manner.

It will be appreciated that each of the elements shown in FIGS. 6–14 are configured and sized individually and collectively for ensuring the overall desired operation of switchback element 110.

As will be readily appreciated from considering FIGS. 6–14, and from the description of the other preferred embodiments, in use, a user, such a free sliding participant or a participant in an inner tube, enter switchback element 110 in direction 36 via trough 64. The user then travels upwardly in direction 44 until the user has, for example, reach upper region 134.

At that point, the user's speed is about 0 m.p.h. The user then returns in the opposite direction (i.e., direction 48) moving downwardly and is guided in downward travel region 116. The user's speed increases and the user exits into trough 74 for further travel in the direction 52.

Depending on the number of users in inner tubes linked together, their size and experience, for example, the user(s) may move from upward travel region 112 to downward travel region 116 at a point prior to reaching outer end region 134.

The size and configuration of upward travel region 112 and downward travel region 116 will be selected so that any premature entry into downward travel region 116 from upward travel region 112 may be controlled as desired by the fabricator and the operator. Desired throughput, the ages of the intended users, and the like will all play a role in selecting such. All such variations are within the scope of the invention.

Figures 6, 7:
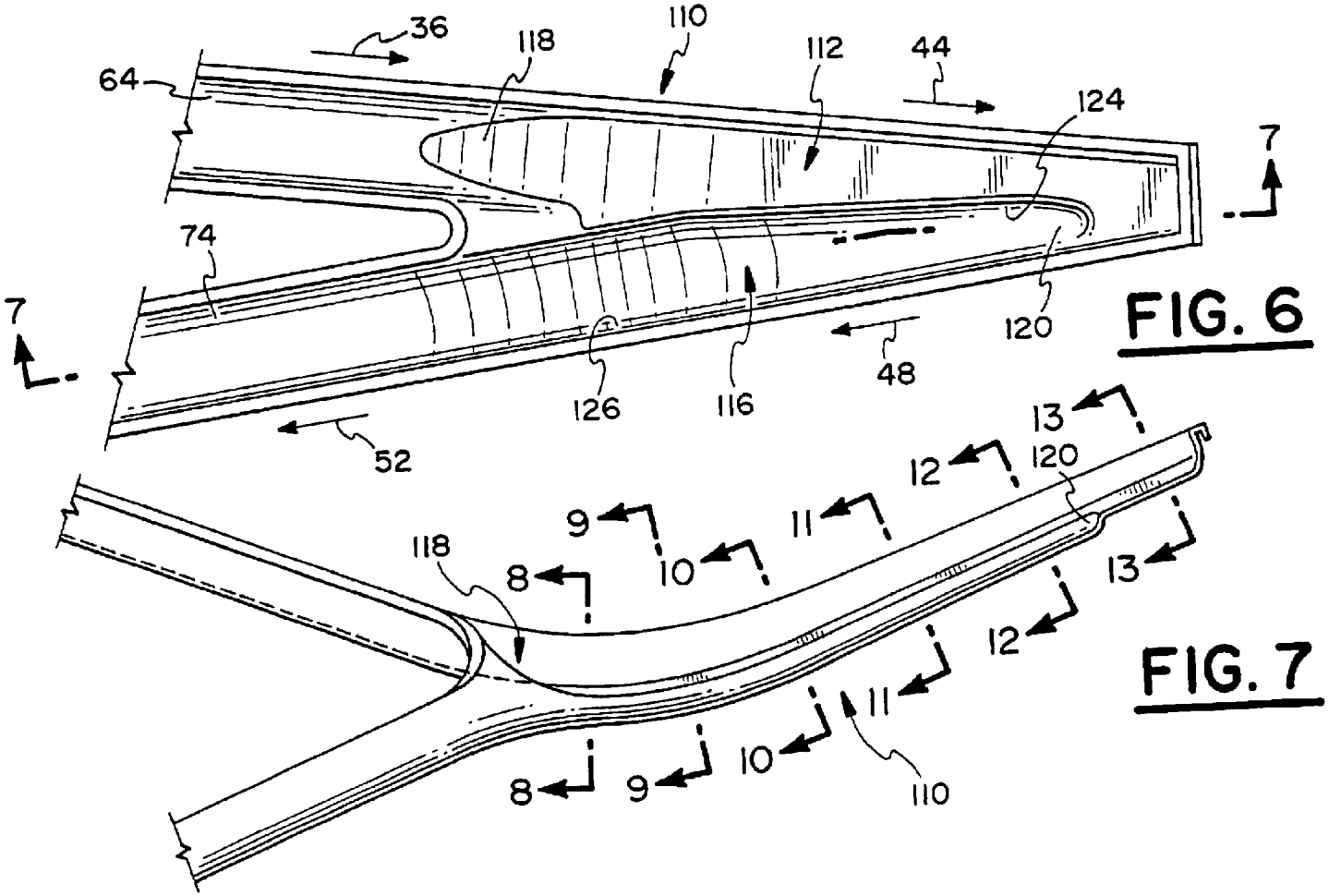
FIG. 6 is a top plan view, similar to FIG. 2, of a further preferred embodiment of a switchback element according to the invention.
FIG. 7 is a cross sectional side view of the switchback element of FIG. 6 according to the invention taken along line 7—7 of FIG. 6.
Figure 13:
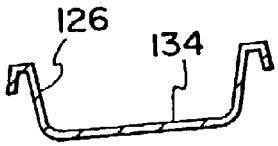
FIGS. 8–13 are sectional views of the switchback element of FIG. 6 according to the invention taken along lines 8—8, 9—9, 10—10, 11—11, 12—12, and 13—13 of FIG. 7.
Figure 12:
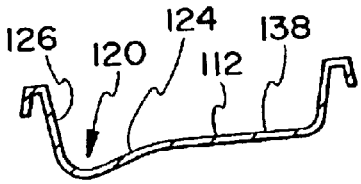
Figure 11:
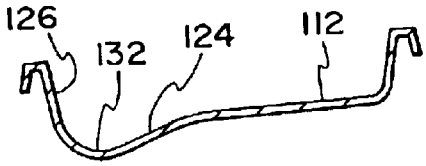
Figure 10:
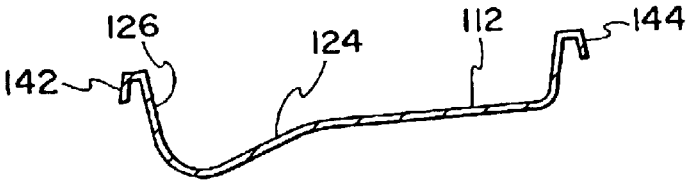
Figure 9:
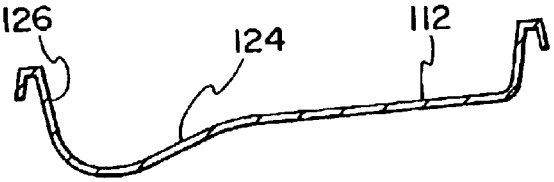
Figure 8:
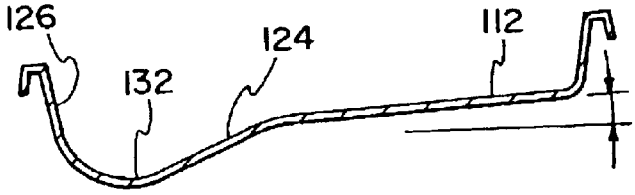
Figure 14:
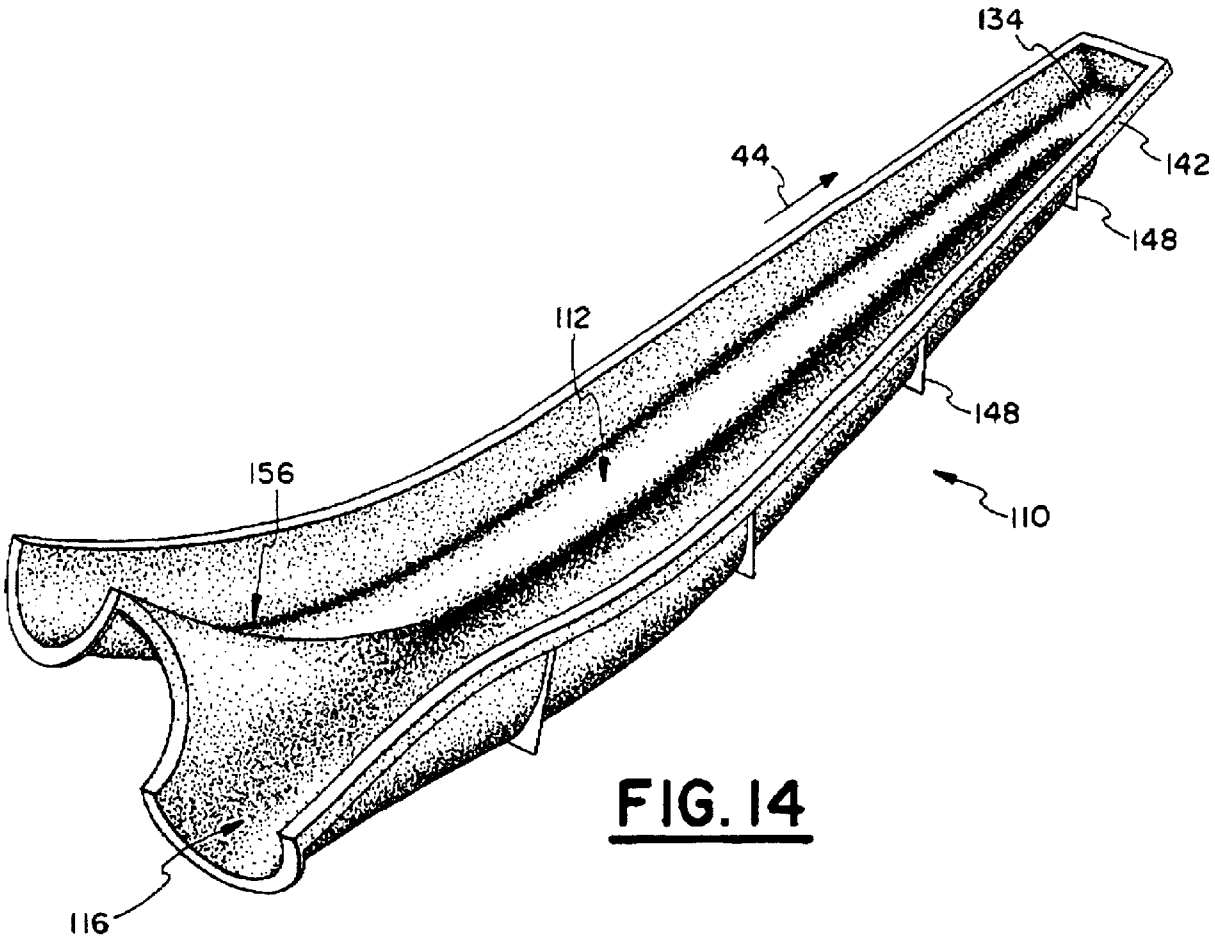
FIG. 14 is a top perspective view of the switchback element of FIG. 6 according to the invention.

It is likewise contemplated that the embodiment of FIG. 6 may be tilted relative to the vertical and relative to the horizontal, such as shown in the embodiment of FIGS. 1–5, particularly as shown in FIG. 4, should such prove desirable to a particular application.

The width and angling of the longitudinal axis of upward travel region 112 and of the downward travel region 116 will be selected so that the direction of the user is changed from up to 90°, and in many cases up to and including about 170° or 180° from the user's initial direction of travel.

In the embodiment of FIG. 6, although the direction of travel of the user has not been shown as having been changed by 180°, the direction of travel of the user has been shown as being changed by closer to about 170° or more.

The configuration of switchback 110 of the embodiment of FIGS. 6–14 ensures that the users do not strike or "bounce off" the outer sidewalls of switchback 110, for example. The slope of the switchback 110 may be selected so that the user gravitates toward, engages, and slides downwardly along the outer sidewall. Thanks to the configuration of switchback element 110 and upward travel region 112, as well as downward travel region 116, the desired relatively high rate of speed, excitement, and rapid and great change of direction of the path of travel of the users may be achieved without unnecessarily jarring the users.

Figure 15:
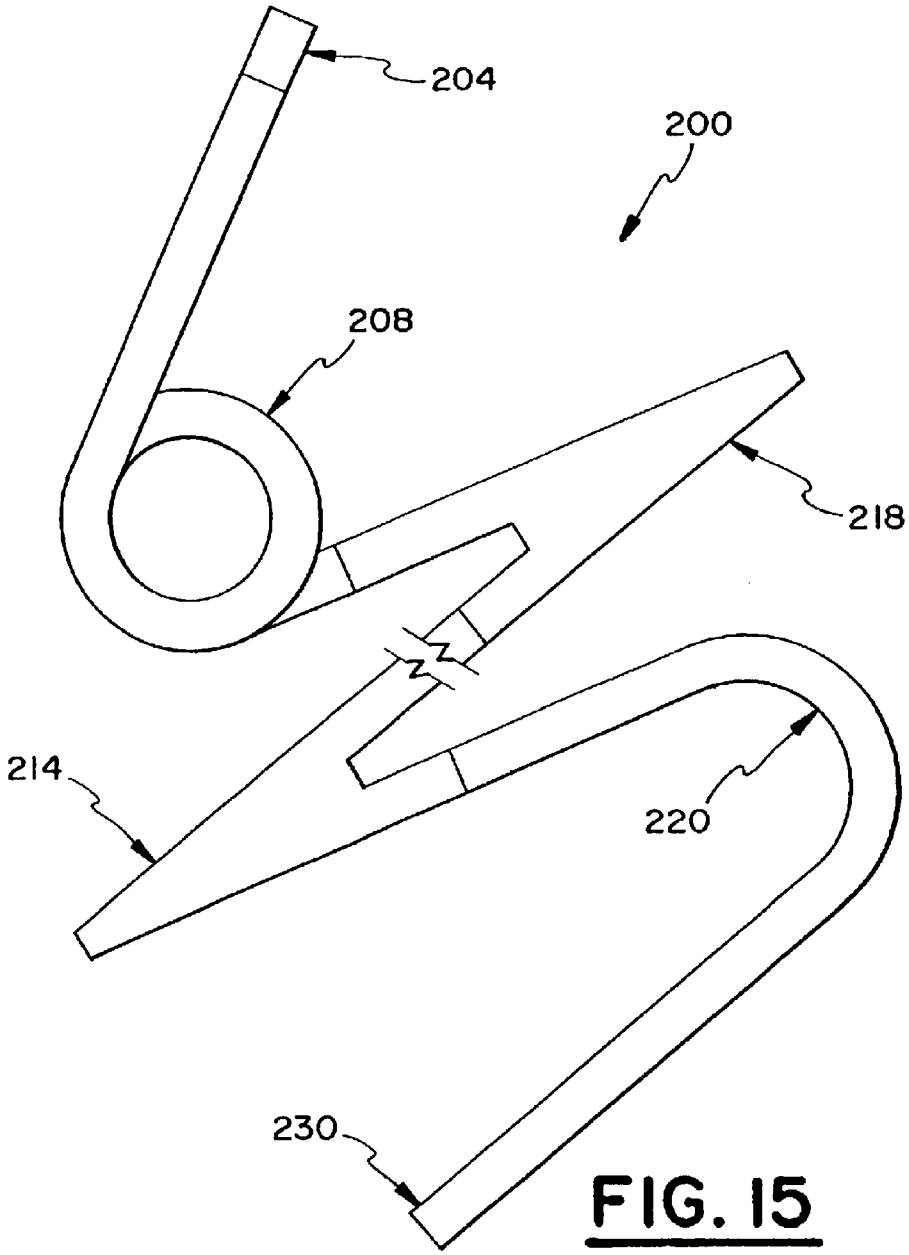
FIG. 15 is a schematic top plan view of another preferred embodiment of a slide apparatus according to the invention.

FIG. 15 illustrates a further preferred embodiment of a slide apparatus 200 according to the invention.

Slide 200 may include a start 204, a water slide flume 208 which may be made, as has been known in the past in the form of a spiral, and one or more righthand switchback elements 218 and lefthand switchback elements 214, as illustrated.

It is likewise contemplated that a further curved element 220 may be provided.

Curved element 220 may be steeply or gently sloped depending on the rate of speed at which the user is to exit slide 200 at an exit 230.

All or a portion of flume 208 may be used in the embodiment of FIG. 15.

It is contemplated that the wide surface of the slide troughs may be made from fiberglass reinforced plastic (FRP), other plastics, sheets of plastic bonded to the base of the trough, so-called gunite concrete products, and the like.

Figure 16:
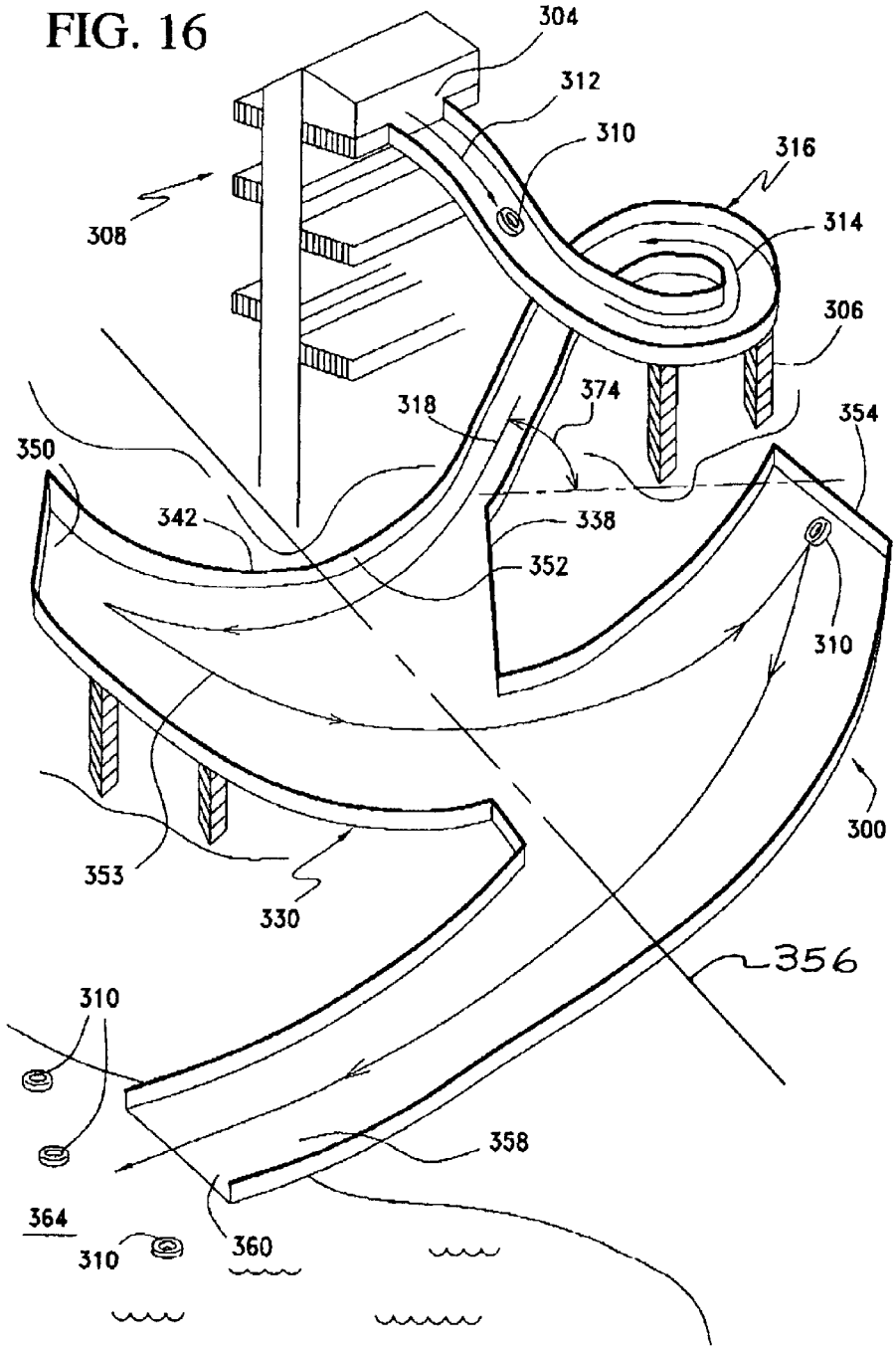
FIG. 16 is a somewhat schematic front perspective view of another embodiment of a slide apparatus according to the invention that includes a portion of a spiral slide which causes a user of the slide apparatus to enter an upwardly open substantially parabolic slide at a lower portion thereof and be propelled first upwardly and then downwardly one or more times along the upwardly open substantially parabolic slide surface.

FIG. 16 shows another embodiment of a slide apparatus 300 according to the invention.

Slide 300 may include a start 304 and one or more supports 306 which elevate some or all of slide 300 to a desired height.

A stair or stair tower 308 may be provided in the case where start 304 is elevated above the surface, such as the ground, on which slide 300 is supported.

Slide 300 may be appreciated by considering the manner in which it may be used.

In use, a user 310 enters at start 304. User 310 may be in a bathing suit or in a bathing suit and supported on an inner tube suitable for sliding along and downwardly along a path of travel 312. Travel path 312 may include at least a portion of a spiral path 314 which may be defined by a respective portion of a spiral slide or slide trough 316. The user may continue downwardly along a further portion 318 of the path of travel toward an exit 338 located at a lower portion 342 of a further slide element 330, such as the illustrated upwardly open substantially parabolic-shaped slide element or slide 330.

User 310 may enter a slide portion or element or further slide 330 at lower portion 342 and, thanks to the speed (i.e., momentum) of user 310 when exiting further travel path 318 at 338, user 310 will continue to be propelled owing to momentum developed by the force of gravity, for example, upwardly along travel path 352 toward an upper region 350 of slide element 330. User 310 will then return downwardly along a further portion 353 of the path of travel to a relatively low point along this portion of travel path 353 and then once again thanks to the momentum of user 310, user 310 will continue onwardly up to a region 354 of slide element 330.

User 310 will then once more reach a point at which the user's speed is 0 or substantially 0 m.p.h. (0/kmh) and then the user 310 will once again continue downwardly toward a lower region 358, which region 358 will may be still lower than other low points of slide element 330 discussed above. User 310 then may be exited at exit 360 into a catchment area 364, such as a run-out pool or "lazy river".

User(s) 310 may then swim around or paddle in catchment region 364 or head directly to an exit therefrom.

A schematic center line 356 or valley 356 indicating a possible low point or valley or collection of the low points described immediately above has been shown for clarity.

It is noted that an entry angle 374 of travel path 318 into the upwardly open parabolic slide surface portion 330 may be varied depending on the location of entry point 338, the size and configuration of slide portion or element or further slide 330, the speed of user 310 at entry point 338, and the like. Entry angle 374 may be varied between about 0°–180°, or any acute angle, such as about 10°–15°.

Figure 17:
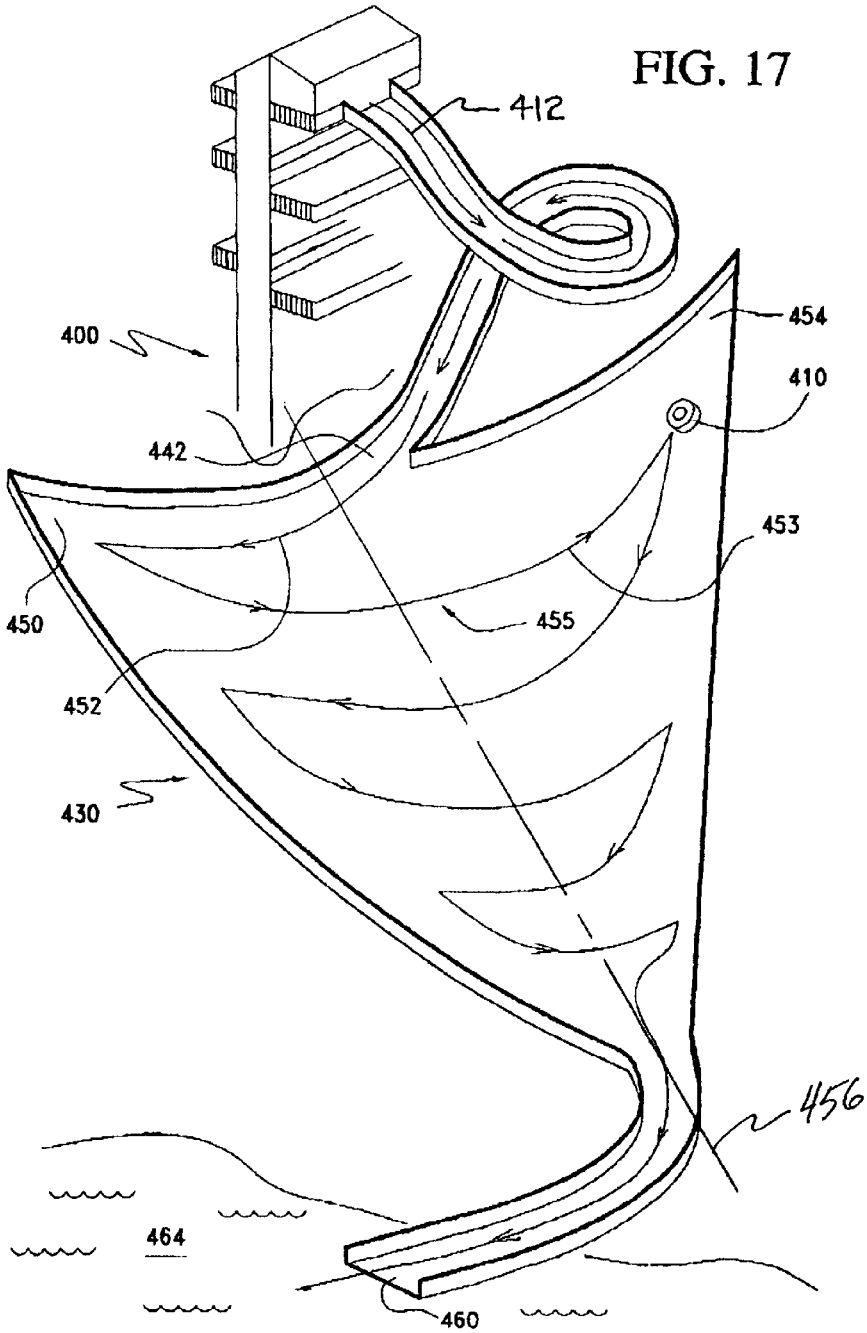
FIG. 17 is a somewhat schematic front perspective view of still further embodiment of a slide apparatus according to the invention that includes a portion of a spiral slide which causes a user of the slide apparatus to enter an upwardly open substantially parabolic slide at a lower portion thereof and be propelled first upwardly and then downwardly one or more times along the upwardly open substantially parabolic slide surface.

FIG. 17 shows another embodiment of a slide apparatus 400 according to the invention.

Slide 400 illustrates an embodiment in which a user 410 enters in a direction 412 and travels in direction 412 first downwardly, and then around at least a portion of a spiral until exiting the first or spiral portion at an entry 442 of a substantially upwardly open parabolic slide portion 430. Slide portion 430 includes an upper region 450 which may be located at a height greater than the height of entry 442. In that manner, the user will first travel upwardly along path 452 toward upper region 450, as will be readily appreciated. The user will then continue downwardly along, typically, a path 453 which is offset from path 452. In that manner, a user traveling upwardly along path 452 would not encounter a further user traveling downwardly along the further path 453. The separation distance would be determined based on the expected size and number of users, building code requirements, and other factors.

The user 410 may then further continue downwardly along path 453 until the user reaches a low point 455 on path 453. Thanks to the momentum of the user, the user would pass through low point 455 and continue upwardly toward a further upper region 454. As will be readily appreciated, the speed of the user would typically slow thanks the resistance of the water acting as a lubricant, any frictional resistance of the slide surface, and the downwardly acting force of gravity, for example. The user would typically reach an uppermost point at which the user's forward or upward speed reaches at about 0 m.p.h. (0 km/h). The user would then continue downwardly, then upwardly, then downwardly, then upwardly, then downwardly, then upwardly, then downwardly or any desired number of times upwardly and downwardly toward and away from a collection of low points or a valley or "center line" 456, analogous to that described above in connection with FIG. 16, and then on toward an exit 460.

The user may be exited into a pool, a slow river, and the like.

Figure 18:
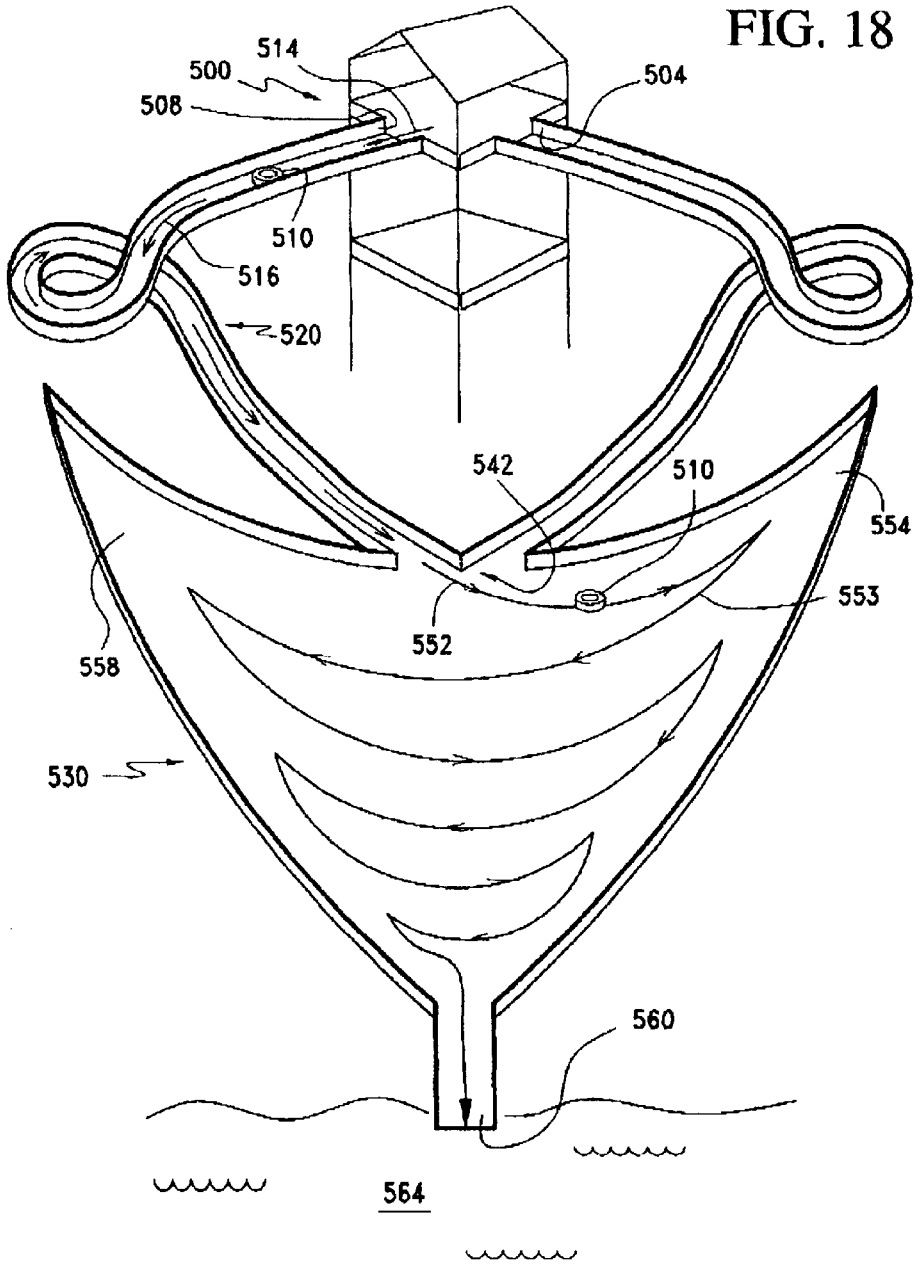
FIG. 18 is a somewhat schematic front perspective view of a still further embodiment of a slide apparatus according to the invention that includes a portion of a spiral slide which causes a user of the slide apparatus to enter an upwardly open substantially parabolic slide at a lower portion thereof and be propelled first upwardly and then downwardly one or more times along the upwardly open substantially parabolic slide surface.
Figure 19:
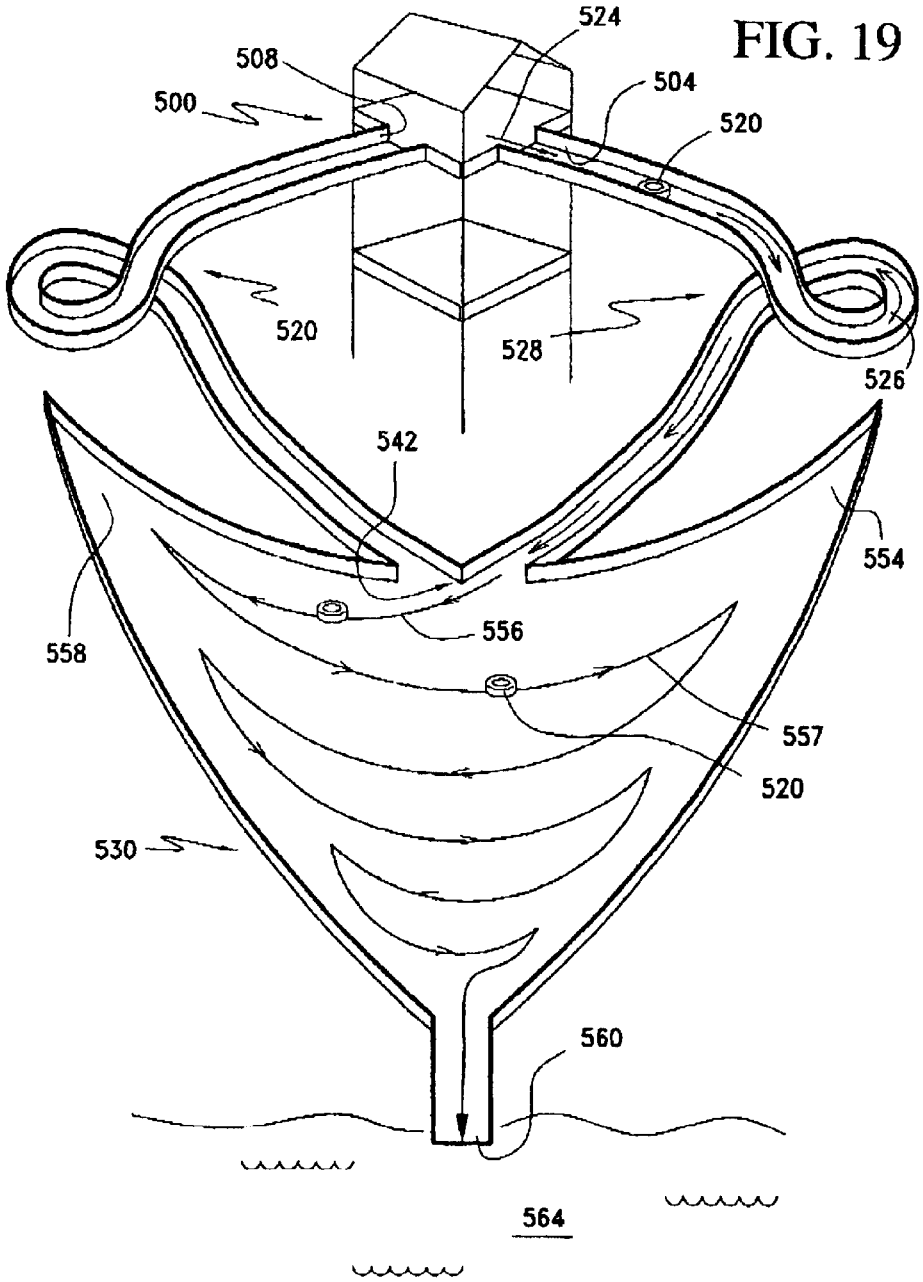
FIG. 19 is a somewhat schematic front perspective view of the slide apparatus according to FIG. 18 that includes a portion of a spiral slide which causes a user of the slide apparatus to enter an upwardly open substantially parabolic slide at a lower portion thereof and be propelled first upwardly and then downwardly one or more times along the upwardly open substantially parabolic slide surface.

FIGS. 18 and 19 illustrate another preferred embodiment of a slide apparatus 500 according to the invention. Slide apparatus 500 may be configured for being a "high capacity" slide.

Slide 500 may include two or more entries 504 and 508, for example.

In use, a user 510 may be directed in a first direction 514 to enter entrance 508. User 510 will then travel under the force of gravity and with or without an added force being applied by a slide apparatus worker in the first direction 514 and a further travel direction 516 in and around a partial or completely spiral left slide 520.

As user 510 continues along the path of travel 516, user 510 enters a further slide portion 530 which may be another upwardly open substantially parabolic curved surface, which may be a portion of a hyperbolic paraboloid, for example, as in the other embodiments. User 510 may enter at exit/entry 542, the location of which may be varied to change the length of the ride, the overall time spent in the ride, the character of the ride (e.g., the length of time and speed in left spiral slide 520 versus further slide 530), and the amount of accelerative "boost" or "afterburner" effect the user experiences at different parts of the slide.

User 510 enters slide portion 530 and then begins moving upwardly along a path of travel 552 at some point after entering slide portion 530, for example. Then, user 510 travels upwardly in an upper region 554 until the force of gravity and other forces, such as frictional losses, cause user 510 to eventually begin movement along a somewhat downwardly extending portion 553 of the path of travel. The user will typically gain speed and momentum, pass through a relatively low point on slide portion or element or further slide 530 and then continue upwardly toward a further upper region 558. This upward and downward or downward and upward and downward path of travel will be repeated any number of times in a manner similar to that described in connection with the other embodiments, and as shown in FIG. 18. User 510 may exit at an exit 560 into a pool or lazy river 564.

FIG. 19 shows the manner in which the other or second entry 504 of slide 500 has been used.

In use, a further user 520 has entered entry 504 and begun travel along a further path of travel 524.

User 520 continues along the illustrated path of travel 544, then along a travel portion 526 of a partially spiral or completely spiral or multiple spiral right slide 528. At an exit of right spiral slide 528 the user enters further slide portion 530 and may travel upwardly along a path of travel 556 toward further upper region 558.

Right at least partially spiral slide 528 and left at least partially spiral slide 528 may be mirror images of each other.

In a manner analogous to the path of travel of user 510 entering entry of 508, as described in connection with FIG. 18 of this embodiment, user 520 then travels downwardly along another path of travel 557 toward further upper region 554.

This downward and upward or upward and downward sequence of spaced apart travel paths is repeated any number of times, also. The number of times may be predetermined by varying the configuration of further slide 530, for example.

Thanks to the provision of two or more entries 504 and 508, a greater number of users may be accommodated, thereby increasing the throughput of users, and increasing contentedness of the users owing to the shortened wait time to use slide 500.

The decision as to whether or not a user enters the slide using 508 or 504 may be determined in any number of ways.

For example, a monitoring system, which may include a signal light, one or more lockout gates to prevent entry into one or both entries 504 and 508, could be placed at one or both of entries 504, 508, indicating which entry is to be used by the next user. Likewise, trained slide apparatus personnel could be used to make the determination with or without the aid of a signal light. Still further, a gate could be used at one or both of entries 504, 508, to provide a physical and visual cue to the user.

If a user wanted to select his or her own entry, such as entry 504, and that user in line is supposed to use entry 508, that user could be directed to simply relinquish his or her place in line and to allow one person to precede him or her into entry 508, which entry 508 the user who wanted to enter 504 did not want to use. In that manner, the user who indicated a preference, could have his or her preference while losing only one space in line. Thus, the correct spacing (i.e., alternate use of entries 504, and 508) of the number of users could be maintained.

Thanks to the predetermined rate (i.e., speed or travel time) at which the users enter the multiple user portion 530 of the slide apparatus, the rate at which the users are allowed to enter entries 504 and 508 can be readily determined.

Figure 20:
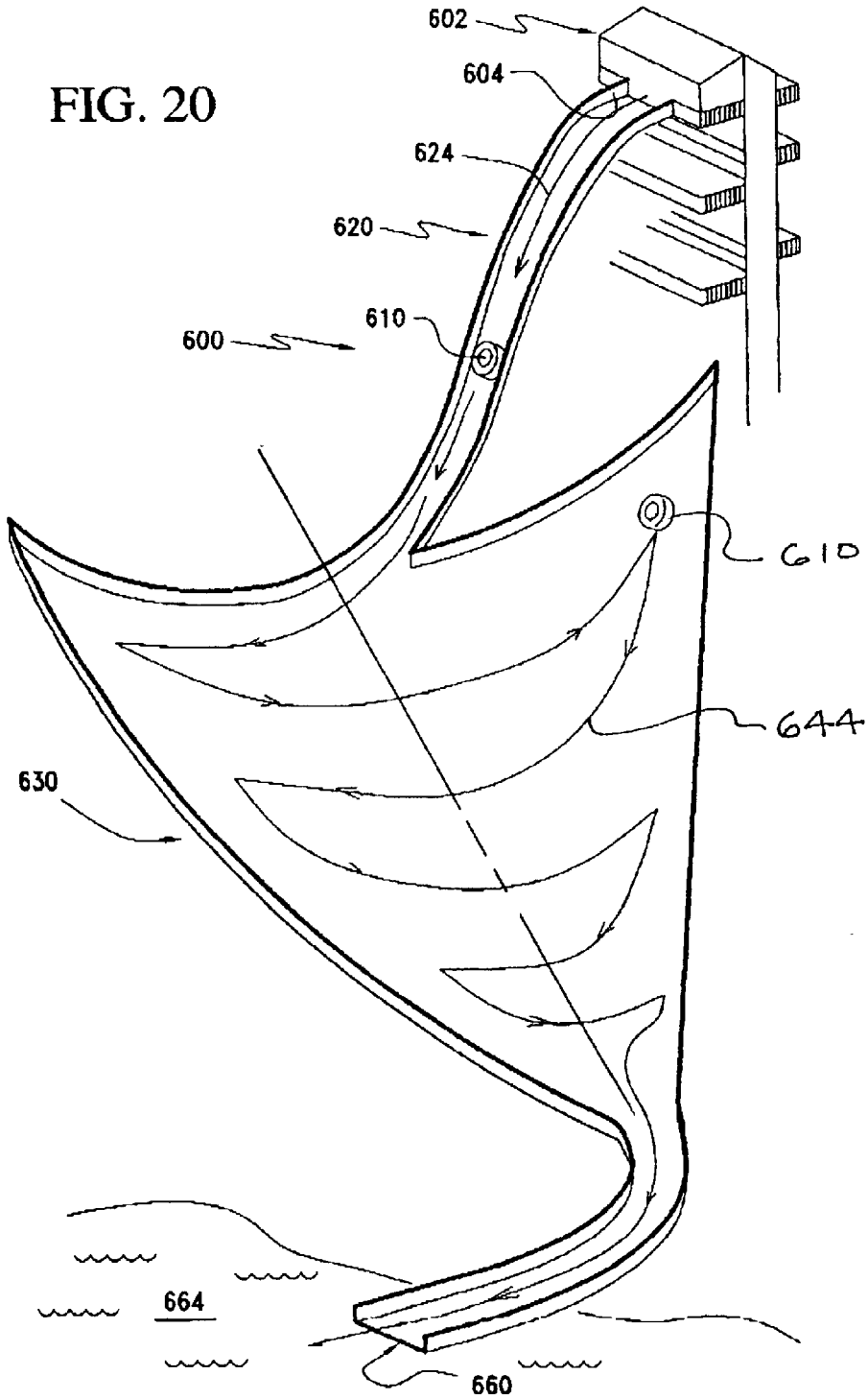
FIG. 20 is a somewhat schematic front perspective view of a still further embodiment of a slide apparatus according to the invention that includes a portion of a substantially straight slide which causes a user of the slide apparatus to enter an upwardly open substantially parabolic slide at a lower portion thereof and be propelled first upwardly and then downwardly one or more times along the upwardly open substantially parabolic slide surface.

FIG. 20 illustrates a further preferred embodiment of a slide 600 according to the invention.

Slide 600 may include a tower 602, such as a stair tower, and an entry 604.

A user 610 may enter entry 604 and slide downwardly along a substantially straight or completely straight path 624, then exit into a further slide 630. Further slide 630 may be an upwardly open parabolic slide similar to slide 430 of FIG. 17. User 610 may continue along a path 644 until exiting at an exit 660 into a pool, a slow river 664, and the like.

Figure 21:
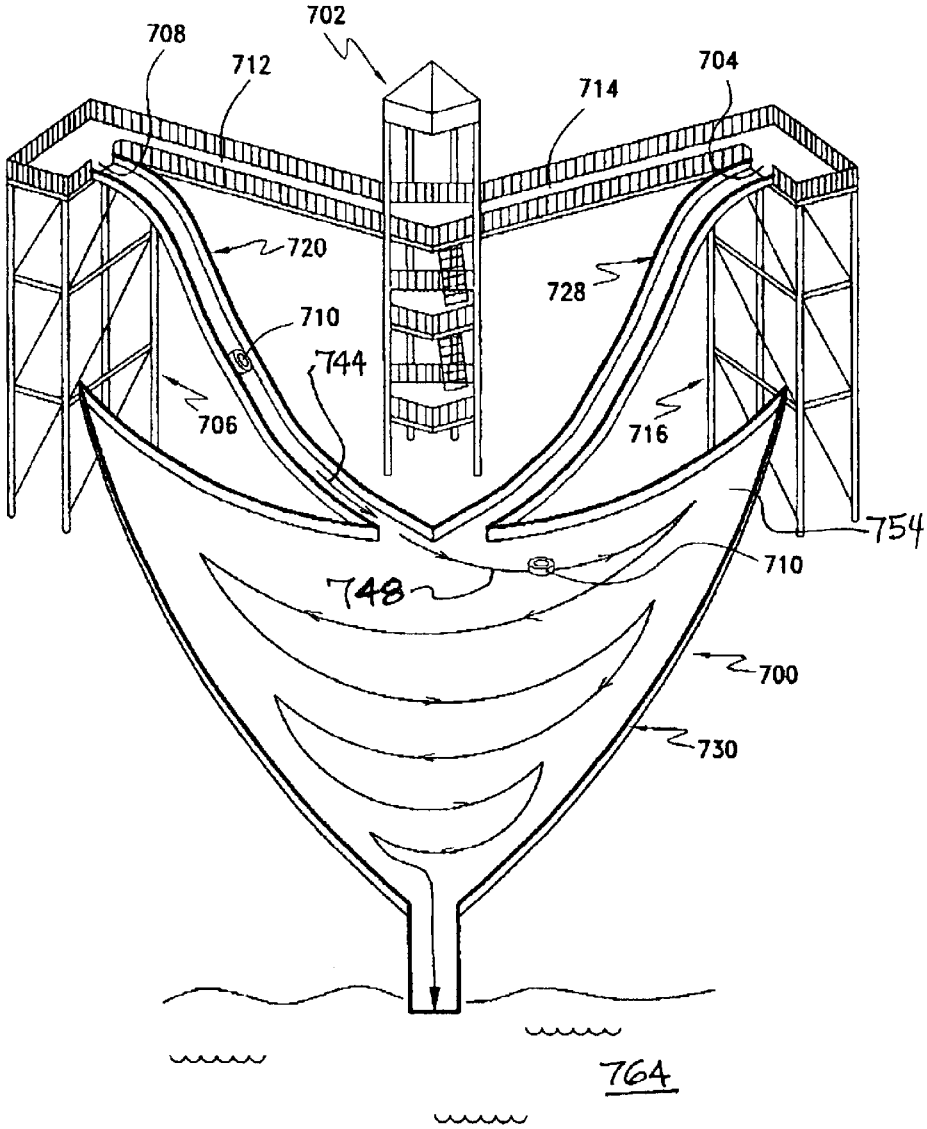
FIG. 21 is a somewhat schematic front perspective view of a still further embodiment of a slide apparatus according to the invention that includes a portion of a pair of opposed substantially straight slides which causes a user of the slide apparatus to enter an upwardly open substantially parabolic slide at a lower portion thereof and be propelled first upwardly and then downwardly one or more times along the upwardly open substantially parabolic slide surface.
Figure 22:
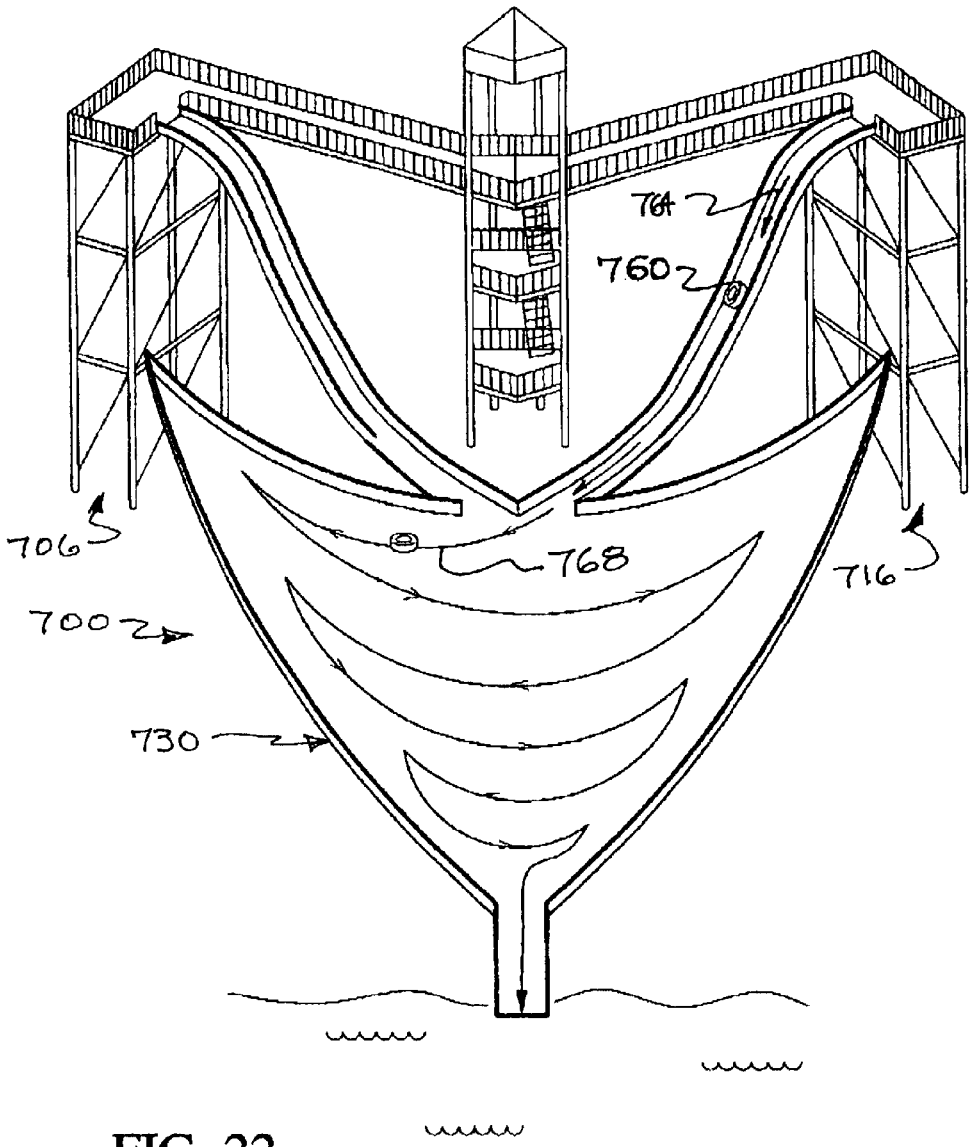
FIG. 22 is a somewhat schematic front perspective view of the slide apparatus according to FIG. 21 that includes a portion of a spiral slide which causes a user of the slide apparatus to enter an upwardly open substantially parabolic slide at a lower portion thereof and be propelled first upwardly and then downwardly one or more times along the upwardly open substantially parabolic slide surface.

FIGS. 21 and 22 illustrate a further preferred embodiment of a slide 700 according to the invention.

Slide 700 may include a stair tower 702, such as the illustrated substantially centrally located stair tower 702 which some or all of the users may use to gain access to a right entry 704 or left entry 708, or both.

In use, a user 710 will have first been directed along a left path 712 or a right path 714, typically. A control gate may be disposed centrally on or near stair tower 702 for controlling the rate at which users 710 enter paths 712 and 714, and hence, entries 708 and 704, respectively.

FIG. 21 illustrates the use of a left stair tower 706 for elevating left entry 708 and a right stair tower 716 for elevating entry 704.

If user 710 chooses or is directed to enter entry 708, he or she will travel downwardly along left slide 720 along a path 744 until exiting into an entry of further slide 730. At that point, as in previously described embodiments, user 710 may travel along a path of travel 748 first upwardly toward an upper right region 754 and then downwardly, then upwardly, then downwardly, then upwardly, and so forth until exiting into a substantially still or slowly moving body of water 764.

FIG. 22 shows slide 700 in use when a user 760 has chosen or been directed to enter right entry 704. In this case, user 760 may travel first substantially downwardly along a travel path 764, then exit into further slide 730 and then begin the back and forth movement along path of travel 768, in a manner analogous to that described in connection with FIG. 21.

Figure 23:
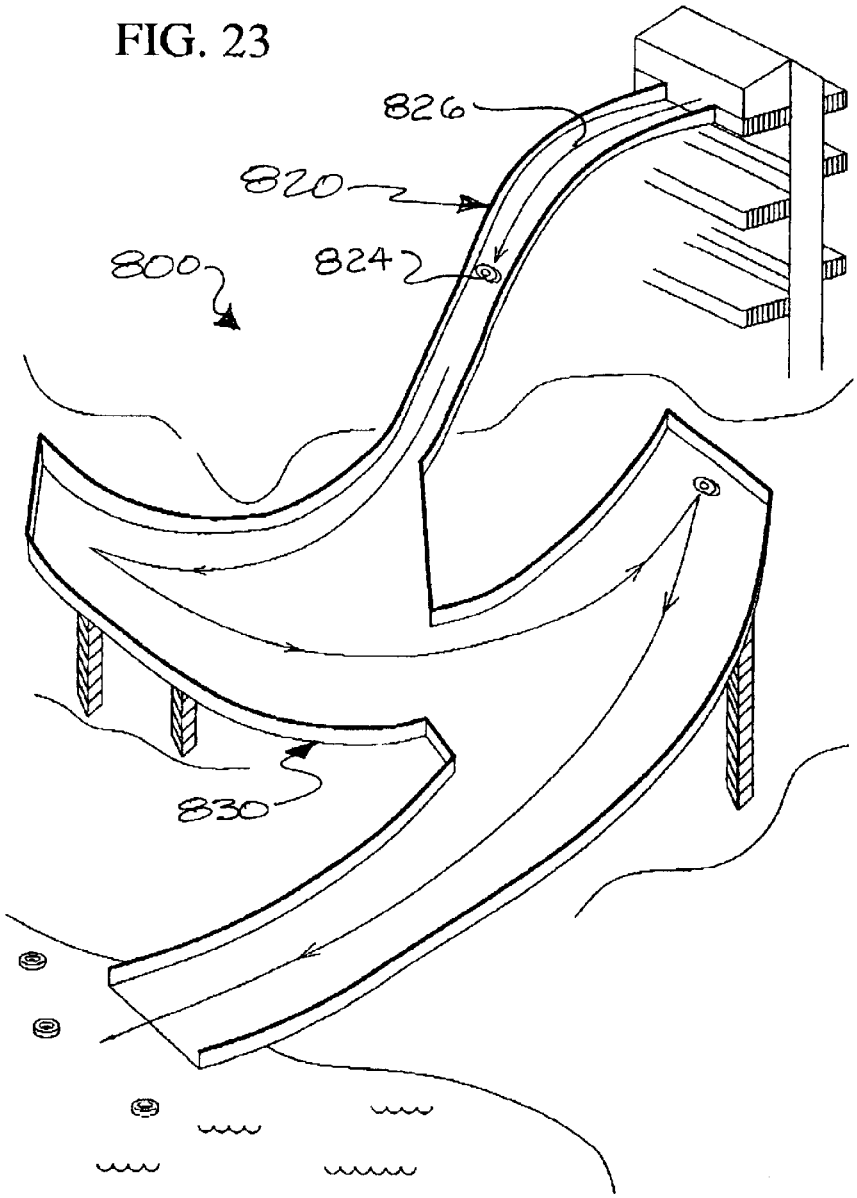
FIG. 23 is a somewhat schematic front perspective view of a still further embodiment of a slide apparatus according to the invention that includes a portion of a substantially straight slide which causes a user of the slide apparatus to enter an upwardly open substantially parabolic slide at a lower portion thereof and be propelled first upwardly and then downwardly one or more times along the upwardly open substantially parabolic slide surface.

FIG. 23 illustrates a yet still further embodiment of a slide 800 according to the invention.

Slide 800 may include a first slide 820 which directs a user 824 to be guided downwardly along a path of travel 826 and then exited into an entrance of a further slide 830.

Slide 800 may have features similar to a combination of slide 620 of FIG. 20 combined with slide 330 of FIG. 16, for example.

In the various embodiments, the straight slide may be straight as viewed transversely or above the path of travel, while the user may travel along an up and down or curved or wavy path as viewed from the slide.

In each of the above described embodiments, the speed of the users can be varied in a number of conventional ways, such as by adding less or more water to the slides at various portions thereof, adding sprays at upper edges of any of the slide portions, fine tuning the configuration of different portions of the slide apparatus, and the like.

It is contemplated that speeds of from about 0 m.p.h. to about 10 m.p.h. or more will be typical, with higher speeds of 35 m.p.h. or more contemplated. For example, the portions of the slide or the overall slide of the various embodiments may be configured so that top travel speeds of the user are reached where the user exits from an initial slide element, such as a spiral slide, and enters at the entry point into the upwardly open substantially parabolic slide portion. That entry point may be at exit/entry 542 of FIG. 18, for example. In the case where a peak speed of, for example 35 m.p.h. is reached at exit/entry of 542 of FIG. 18, a reduced speed of about 30 m.p.h. may be reached at the first upper right region 554, a further reduced speed of 25 m.p.h. may be reached at the first upper left region 558 as the user travels along path 553, a further reduced speed of 20 m.p.h. may be reached at the second upper right change of direction point on the right side, a further reduced speed of 15 m.p.h. may be reached at the middle change of direction point on the left side of travel path 553, a still further reduced speed of 10 m.p.h. may be reached at the still lower right change of direction point on the right side of slide 530, the still further reduced speed of 5 m.p.h. may be reached at the lower left, third change of direction point on the left side of slide 530, and the user will then exit from exit 560 into pond 564 at about 0 m.p.h.

The slide may be made as a free-standing structure, or incorporated into other amusement rides, buildings, directly or indirectly on hillsides, or on built-up support surfaces, such as excavated and worked earth, for example.

Further variations of production and assembly may be performed as set forth in U.S. Pat. No. 5,137,497 to Dubeta, which is incorporated herein by reference.

One of the upwardly open substantially parabolic slide surfaces according to the invention may be made, for example, by using a conic section in the valley, and one or more substantially flat panels fastened tangentially to the conic section.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A slide apparatus comprising:

a) a partially spiral slide having a slide surface, the slide surface being configured for causing a user traveling along the slide surface to travel along a partially-spiral path;

b) a further slide, the further slide including a portion of an upwardly open curved surface;

c) the portion of the upwardly open curved surface defining a further slide surface;

d) said further slide surface being configured so for causing, in use, a user to slide on the further slide surface along a substantially predetermined path, in use;

e) a switchback being provided in said further slide;

f) said switchback being configured for causing, in use, a user traveling along the further slide surface to be switched from a first direction of travel along the substantially predetermined path to a second direction of travel along the substantially predetermined path, the second direction of travel differing from the first direction of travel;

g) said switchback being a portion of the upwardly open curved surface; and h) the substantially predetermined path and the partially spiral path being fluidly connected.

2. An apparatus as in claim 1, wherein:

a) the substantially predetermined path and the partially spiral path are directly connected.

3. An apparatus as in claim 2, wherein:

a) An entry of the substantially predetermined path is connected to an exit of the partially spiral path.

4. An apparatus as in claim 3, wherein:

a) the entry of the substantially predetermined path is located at a lower portion of the upwardly open curved surface.

5. An apparatus as in claim 1, wherein:

a) said switchback changes the direction of travel of the user by more than 90 degrees.

6. An apparatus as in claim 1, wherein:

a) said switchback changes the direction of travel of the user by at least about 170 degrees.

7. An apparatus as in claim 1, wherein:

a) said switchback changes the direction of travel of the user by about 180 degrees.

8. An apparatus as in claim 1, wherein:

a) said switchback is sufficiently upwardly sloped so that the speed of a user is reduced to substantially 0 miles per hour, in use.

9. An apparatus as in claim 1, wherein:

a) said switchback includes a slide surface defining at least a portion of a hyperbolic paraboloid.

10. An apparatus as in claim 1, wherein:

a) a second switchback is provided on the further slide surface for changing the direction of a user, in use.

11. An apparatus as in claim 10, wherein:

a) a wall separates said switchback from said second switch back.

12. An apparatus as in claim 10, wherein:

a) said switchback is disposed substantially adjacent said second switchback.

13. An apparatus as in claim 1, wherein:

a) Said switchback includes at least two first switchbacks, each of said at least two first switchbacks being configured for changing the direction of travel of a user, in use; and b) At least two second switchbacks are provided, each of said at least two second switchbacks being configured for changing the direction of travel of a user, in use.

14. An apparatus as in claim 1, wherein:

a) said switchback is substantially free of a portion of a spiral, as viewed from a direction transverse to the path of travel.

15. A slide apparatus comprising:

a) a partially spiral slide having a slide surface, the slide surface being configured for causing a user traveling along the slide surface to travel along a partially spiral path;

b) a further slide, the further slide including a portion of an upwardly open substantially curved surface;

c) the portion of the upwardly open substantially curved surface defining a further slide surface;

d) said further slide surface being configured for causing a user to slide on the further slide surface along a substantially predetermined path;

e) said further slide surface being configured for causing a user traveling along the further slide surface to be switched from a first direction of travel along the substantially predetermined path to a second direction of travel along the substantially predetermined path, the second direction of travel differing from the first direction of travel; and f) the substantially predetermined path being adjacent to the partially spiral path.

16. An apparatus as in claim 15, wherein:

a) the substantially predetermined path and the partially spiral path are directly connected.

17. An apparatus as in claim 16, wherein:

a) an entry of the substantially predetermined path is connected to an exit of the partially spiral path.

18. An apparatus as in claim 17, wherein:

a) the entry of the substantially predetermined path is located at a lower portion of the upwardly open curved surface.

19. An apparatus as in claim 15, wherein:

a) said further slide surface changes the direction of travel of the user by more than 90 degrees.

20. An apparatus as in claim 15, wherein:

a) said further slide surface is sufficiently upwardly sloped so that the speed of a user is reduced to substantially 0 miles per hour, in use.

21. An apparatus as in claim 15, wherein:

a) the partially spiral slide includes two at least partially spiral slides; and b) an exit of each of the two partially spiral slides is connected to an entry of the substantially predetermined path.

22. An apparatus as in claim 15, wherein:

a) said further slide surface is substantially free of a portion of a spiral, as viewed from a direction transverse to the substantially predetermined path.

23. An apparatus as in claim 15, wherein;

a) said first direction of travel is disposed substantially adjacent said second direction of travel.

24. An apparatus as in claim 15, wherein:

a) said first direction of travel and said second direction of travel are substantially free of walls disposed between them.

25. A slide apparatus comprising:

a) a substantially straight slide having a slide surface, the slide surface being configured for causing a user traveling along the slide surface to travel along a substantially straight travel path, as viewed from a direction transverse to the travel path;

b) a further slide, the further slide including a portion of an upwardly open curved surface;

c) the portion of the upwardly open curved surface defining a further slide surface;

d) said further slide surface being configured for causing, in use, a user to slide on the further slide surface along a substantially predetermined path, in use;

e) a switchback being provided in said further slide;

f) said switchback being configured for causing, in use, a user traveling along the further slide surface to be switched from a first direction of travel along the substantially predetermined path to a second direction of travel along the substantially predetermined path, the second direction of travel differing from the first direction of travel;

g) said switchback being a portion of the upwardly open curved surface; and h) the substantially predetermined path being disposed adjacent the substantially straight path.

26. An apparatus as in claim 25, wherein:

a) the substantially predetermined path and the substantially straight path are directly connected.

27. An apparatus as in claim 25, wherein:

a) an entry of the substantially predetermined path is connected to an exit of the substantially straight path.

28. An apparatus as in claim 25, wherein:

a) a second substantially straight slide having a slide surface is provided, the slide surface being configured for causing a user traveling along the slide surface to travel along a second substantially straight travel path, as viewed from a direction transverse to the travel path; and b) the substantially straight slide and the second substantially straight slide each exit into an entry of the further slide.

29. An apparatus as in claim 28, wherein:

a) a control is provided-for directing a user to enter the substantially straight slide or the second substantially straight slide.

30. An apparatus as in claim 25, wherein:

a) the substantially straight path is substantially straight as viewed from the above the substantially straight path.

* * * * *

UNITED STATES PATENT AND TRADEMARK OFFICE

CERTIFICATE OF CORRECTION

PATENT NO. : 6,743,107 B2
DATED : June 1, 2004
INVENTOR(S) : Dubeta

It is certified that error appears in the above-identified patent and that said Letters Patent is hereby corrected as shown below:

Column 6,
Line 1, replace "than 0° to 2 or 30 or more. Angle 82 may be about 0°," with
-- than 0° to 2 or 3° or more. Angle 82 may be about 0°, --

Signed and Sealed this

Nineteenth Day of July, 2005

JON W. DUDAS
*Director of the United States Patent and Trademark Office*